US008519917B2

(12) United States Patent
Ryu et al.

(10) Patent No.: US 8,519,917 B2
(45) Date of Patent: Aug. 27, 2013

(54) ORGANIC LIGHT EMITTING DISPLAY AND METHOD OF DRIVING THE SAME

(75) Inventors: Do-Hyung Ryu, Yongin (KR); Keum-Nam Kim, Yongin (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 285 days.

(21) Appl. No.: 12/801,330

(22) Filed: Jun. 3, 2010

(65) Prior Publication Data

US 2011/0063283 A1 Mar. 17, 2011

(30) Foreign Application Priority Data

Sep. 14, 2009 (KR) ..... 10-2009-0086336

(51) Int. Cl.
*G09G 3/32* (2006.01)

(52) U.S. Cl.
USPC ..... 345/77; 345/76

(58) Field of Classification Search
USPC ..... 345/76, 77; 711/100
See application file for complete search history.

(56) References Cited

U.S. PATENT DOCUMENTS

| | | | | |
|---|---|---|---|---|
| 5,943,259 | A | 8/1999 | Choi | |
| 7,038,938 | B2 | 5/2006 | Kang | |
| 2006/0119554 | A1* | 6/2006 | Kawae | 345/77 |
| 2007/0028030 | A1* | 2/2007 | Mahrla et al. | 711/100 |
| 2007/0274150 | A1* | 11/2007 | Gorobets | 365/230.03 |
| 2009/0051628 | A1* | 2/2009 | Kwon | 345/77 |

FOREIGN PATENT DOCUMENTS

| | | | |
|---|---|---|---|
| KR | 10-0226746 | B1 | 7/1999 |
| KR | 10-2003-0027846 | A | 4/2003 |
| KR | 10-2005-0058929 | A | 6/2005 |
| KR | 10-0858615 | B1 | 9/2008 |
| KR | 10-0873707 | B1 | 12/2008 |
| KR | 10 2009-0020190 | A | 2/2009 |

OTHER PUBLICATIONS

Korean Office Action in KR 10 2009-0086336, dated Jul. 29, 2011 (Ryu, et al.).
Office Action issued in corresponding Korean application, 10-2009-0086336, dated Mar. 21, 2011.

* cited by examiner

*Primary Examiner* — Alexander Eisen
*Assistant Examiner* — Mark Regn
(74) *Attorney, Agent, or Firm* — Lee & Morse, P.C.

(57) ABSTRACT

A method of driving an organic light emitting display, includes extracting information on deterioration of an organic light emitting diode (OLED) and information on a threshold voltage and mobility of a driving transistor included in each of the pixels to store the information in a memory unit during a non-display period, converting input data into corrected data using the information items stored in the memory unit, and supplying data signals corresponding to the corrected data to data lines, wherein, extracting the information, includes storing the information on the deterioration of the OLED and the information on the threshold voltage and mobility of the driving transistor in a non-volatile memory, and storing the information in a volatile memory.

22 Claims, 7 Drawing Sheets

ORGANIC LIGHT EMITTING DISPLAY AND METHOD OF DRIVING THE SAME

BACKGROUND

1. Field

Embodiments relate to an organic light emitting display and a method of driving the same. More particularly, embodiments relate to an organic light emitting display capable of compensating for threshold voltage variations of driving transistors in the outside of pixels to display an image with uniform brightness and a method of driving the same.

2. Description of the Related Art

Flat panel displays (FPD) that are lighter in weight and smaller in volume relative to cathode ray tubes (CRT). FPDs include liquid crystal displays (LCD), field emission displays (FED), plasma display panels (PDP), and organic light emitting displays.

Among FPDs, organic light emitting displays display images using organic light emitting diodes (OLED) that generate light by re-combination of electrons and holes. Generally, organic light emitting displays have relatively high response speeds and relatively lower power consumption. More particularly, e.g., over time, a data signal may result in light of relatively lower brightness.

SUMMARY

Embodiments are therefore directed to organic light emitting displays and methods of driving such light emitting displays, which substantially overcome one or more of the problems due to the limitations and disadvantages of the related art.

It is therefore a feature of an embodiment to provide an organic light emitting display capable of extracting, from a pixel, information regarding threshold voltage and mobility of a driving transistor as well as information regarding deterioration of an organic light emitting diode (OLED) to compensate for information extracted from a pixel and to display an image with uniform brightness and a method of driving the same.

It is therefore a separate feature of an embodiment to provide an organic light emitting display capable of improving, e.g., increasing, operation frequency characteristic of a memory unit storing information items extracted from the pixel and a method of driving the same.

It is therefore a separate feature of an embodiment to provide an organic light emitting display and a method of driving such an organic light emitting display in which information on the threshold voltage and mobility of a driving transistor and information on the deterioration of an OLED are extracted from the pixel to compensate for the extracted information items externally from the pixel such that the an image with improved brightness uniformity, e.g., uniform brightness, can be displayed while the pixel has a relatively simple structure.

In particular, according to the present invention, meanwhile the information on the threshold voltage and mobility of the driving transistor and the information on the deterioration of the OLED are stably stored using a non-volatile memory, the information items are also stored in a volatile memory and operations are performed with reference to the volatile memory to improve the operation frequency characteristic of the memory unit.

At least one of the above and other features and advantages may be realized by providing a method of driving an organic light emitting display, including extracting information on deterioration of an organic light emitting diode (OLED) and information on a threshold voltage and mobility of a driving transistor included in each of the pixels to store the information in a memory unit during a non-display period, converting input data into corrected data using the information items stored in the memory unit, and supplying data signals corresponding to the corrected data to data lines, wherein extracting the information includes storing the information on the deterioration of the OLED and the information on the threshold voltage and mobility of the driving transistor in a non-volatile memory; and storing the information in a volatile memory.

Converting input data into corrected data using the information items stored in the memory unit may include reducing and/or eliminating an effect of the deterioration of the OLED and/or deviation in the threshold voltage and mobility of the driving transistor on brightness of the pixels.

Storing the information in the non-volatile memory may occur before storing the information in the volatile memory.

Storing the information in the volatile memory may occur before storing the information in the non-volatile memory.

Converting the input data into corrected data may include using the information stored in the volatile memory before storing the information in the non-volatile memory.

Converting input data into corrected data may include converting the input data into the corrected data using the information stored in the volatile memory.

Extracting information may include extracting the information on the deterioration of the OLED and the information on the threshold voltage and mobility of the driving transistor to generate digital values, storing the digital values in the non-volatile memory using a first page memory and a second page memory that are alternately coupled to the non-volatile memory, and moving the information stored in the non-volatile memory to the volatile memory to store the moved information.

The first page memory and the second page memory may complementarily perform read and write operations.

Extracting information may include sensing the information on the deterioration of the OLED during one frame period of the non-display period to generate a first digital value, storing the first digital value in the memory unit, sensing the information on the threshold voltage and mobility of the driving transistor during another frame period of the non-display period to generate a second digital value, and storing the second digital value in the memory unit.

Generating the first digital value may include supplying first current to the OLED, and converting a first voltage applied to the OLED corresponding to the first current into the first digital value.

Generating the second digital value may include sinking second current via the driving transistor, and converting a second voltage applied to a gate electrode of the driving transistor into the second digital value corresponding to the second current.

Generating the second digital value and storing the second digital value in the memory unit may be previously performed when generating specifications for the organic light emitting display.

Extracting the information and converting the input data into corrected data may be performed during the non-display period after a power is applied to the organic light emitting display and before an image is displayed.

At least one of the above and other features and advantages may be separately realized by providing an organic light emitting display, including a plurality of pixels coupled to data lines, scan lines, emission control lines, and sensing lines, a sensing unit adapted to sense information on deterioration of an OLED and information on a threshold voltage and mobility of a driving transistor that are included in each of the pixels, a converting unit adapted to store the information on the deterioration of the OLED and the information on the threshold voltage and mobility of the driving transistor that are sensed by the sensing unit and to convert input data into corrected data using the information, and a data driver adapted to receive the corrected data output from the converting unit to generate data signals, wherein the converting unit includes a memory unit adapted to store the information on the deterioration of the OLED and the information on the threshold voltage and mobility of the driving transistor and a converting circuit adapted to convert the input data into the corrected data using the information stored in the memory unit, and wherein the memory unit includes a non-volatile memory and a volatile memory that can exchange information.

The information on the deterioration of the OLED and the information on the threshold voltage and mobility of the driving transistor that are sensed by the sensing unit may be stored in the non-volatile memory and are moved to the volatile memory to be stored, and wherein the converting unit converts the input data into the corrected data with reference to the volatile memory.

The information on the deterioration of the OLED and the information on the threshold voltage and mobility of the driving transistor that are sensed by the sensing unit may be directly stored in the volatile memory without passing through the non-volatile memory, and wherein the converting unit may convert the input data into the corrected data with reference to the volatile memory.

The memory unit may further include a first page memory and a second page memory adapted to receive the information on the deterioration of the OLED and the information on the threshold voltage and mobility of the driving transistor from the sensing unit and to store the received information in the non-volatile memory, and switching elements coupled between the first page memory and the non-volatile memory, between the second page memory and the non-volatile memory, and between the non-volatile memory and the volatile memory.

The switching element coupled between the first page memory and the non-volatile memory and the switching element coupled between the second page memory and the non-volatile memory may be alternately turned on during a period where the information items supplied from the first and second page memories are stored in the non-volatile memory.

The switching elements coupled between the non-volatile memory and the volatile memory may be turned on after the information items supplied from the first and second page memories are stored in the non-volatile memory.

The memory unit may further include a switching element arranged directly between the sensing unit and the volatile memory.

The sensing unit may include a sensing circuit positioned in each channel and including a current source unit adapted to supply a first current to the pixels and at least one current sink unit adapted to sink second current from the pixels, and at least one analog-to-digital converter (ADC) adapted to convert a first voltage applied to the OLED into a first digital value corresponding to the first current and to convert a second voltage applied to a gate electrode of the driving transistor into a second digital value corresponding to the second current.

The display may include a switching unit adapted to couple one of the sensing unit and the data driver to the data lines.

BRIEF DESCRIPTION OF THE DRAWINGS

The above and other features and advantages will become more apparent to those of ordinary skill in the art by describing in detail exemplary embodiments with reference to the attached drawings, in which.

DETAILED DESCRIPTION

Figure 1:
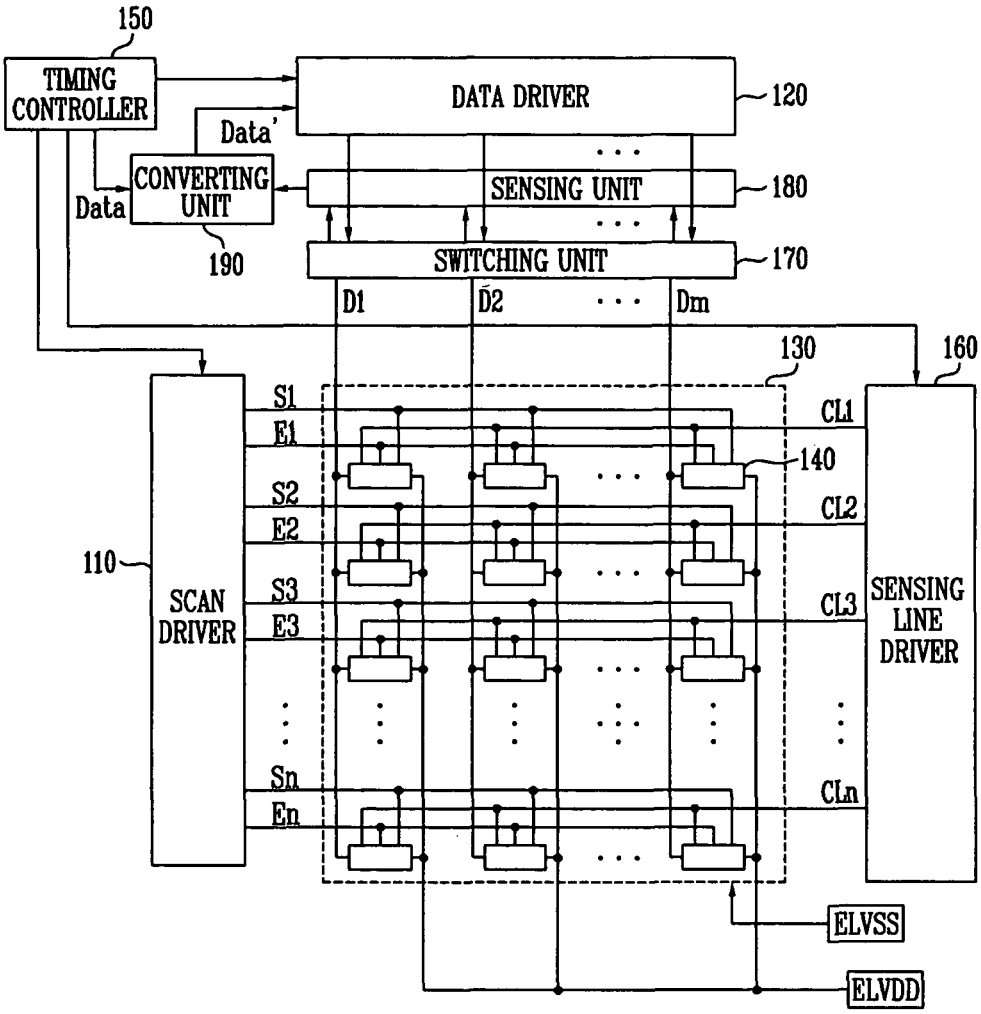
FIG. 1 illustrates a block diagram of an exemplary embodiment of an organic light emitting display.

Korean Patent Application No. 10-2009-0086336, filed on Sep. 14, 2009, in the Korean Intellectual Property Office, and entitled: "Organic Light Emitting Display Device and Driving Method Thereof" is incorporated by reference herein in its entirety.

Exemplary embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the invention to those skilled in the art.

In the following description, it will be understood that when a first element is described as being coupled to a second element, the first element may be directly coupled to the second element, but may also be indirectly coupled to the second element via one or more other elements. It will also be understood that when an element is referred to as being "between" two elements, it can be the only element between the two elements, or one or more intervening elements may also be present. Further, some of the elements that are not essential to the complete understanding of the invention are omitted for clarity. Like reference numerals refer to like elements throughout the specification.

FIG. 1 illustrates a block diagram of an exemplary embodiment of an organic light emitting display.

Referring to FIG. 1, the organic light emitting display may include a scan driver 110, a data driver 120, a pixel unit 130, a timing controller 150, a sensing line driver 160, a switching unit 170, a sensing unit 180, and/or a converting unit 190.

The pixel unit 130 may include pixels 140 respectively coupled to scan lines S1 to Sn, emission control lines E1 to En, sensing lines CL1 to CLn, and data lines D1 to Dm. The scan driver 110 may drive the scan lines S1 to Sn and the emission control lines E1 to En. The sensing line driver 160 may driver the sensing lines CL1 to CLn. The data driver 120 may drive the data lines D1 to Dm. The timing controller 150 may control the scan driver 110, the data driver 120, and the sensing line driver 160.

The sensing unit 180 may extract information regarding deterioration of organic light emitting diodes (OLEDs) included in the pixels 140 and information regarding threshold voltage and mobility of respective driving transistors. The switching unit 170 may selectively couple the sensing unit 180 and the data driver 120 to the data lines D1 to Dm. The converting unit 190 may store the information sensed by the sensing unit 180 and may convert input data to display an image with improved uniform brightness. Embodiments may employ the sensed information to improve brightness uniformity by reducing and/or eliminating brightness variations resulting from deterioration of the OLEDs and/or threshold voltage and/or mobility of driving transistors.

In the pixel unit 130, the plurality of pixels 140 may be positioned at intersections of the scan lines S1 to Sn, the emission control lines E1 to En, and the data lines D1 to Dm. The pixels 140 may receive power from a first power source ELVDD and a second power source ELVSS, which may be external power sources. The pixels 140 may emit light with brightness corresponding to an amount current supplied from the first power source ELVDD to the second power source ELVSS via the OLEDs based on respective data signals.

The scan driver 110 may supply scan signals to the scan lines S1 to Sn in accordance with the timing controller 150. The scan driver 110 may supply emission control signals to the emission control lines E1 to En in accordance with the timing controller 150.

The sensing line driver 160 may supply sensing signals to the sensing lines CL1 to CLn in accordance with the timing controller 150.

The data driver 120 may supply data signals to the data lines D1 to Dm in accordance with the timing controller 150.

The switching unit 170 may selectively couple the sensing unit 180 and the data driver 120 to the data lines D1 to Dm. The switching unit 170 may include a pair of switching elements coupled to each of the data lines D1 to Dm. More particularly, e.g., the switching unit 170 may include a pair of switching elements coupled to each channel or column of the pixels 140.

The sensing unit 180 may extract information regarding deterioration of the OLEDs included in the pixels 140 and may supply the extracted deterioration information to the converting unit 190. The sensing unit 180 may extract information regarding a threshold voltage and mobility of driving transistors of the pixels 140, and may supply the extracted information regarding the threshold voltage and mobility to the converting unit 190. The sensing unit 180 may include a sensing circuit coupled to each of the data lines D1 to Dm (e.g., to each channel or column of the pixels 140).

Information regarding deterioration of the OLEDs may be extracted during a first non-display period that is after a power source is applied to the organic light emitting display and before an image is displayed. That is, information regarding the deterioration of the OLEDs may be extracted whenever power is supplied to the organic light emitting display, e.g., the first and the second power sources are coupled to the organic light emitting display.

Information regarding threshold voltage and mobility of the driving transistors may be extracted during a second non-display period that is after a power is supplied to the organic light emitting display and before an image is displayed.

Embodiments are not, however, limited thereto. For example, the information regarding threshold voltage and mobility may be extracted before the initial organic light emitting display is supplied as a product. In such cases, the information regarding the threshold voltage and mobility may be previously extracted, e.g., as a device specification, that is supplied with the device. More particularly, the information regarding threshold voltage and mobility of the driving transistor may be extracted whenever power is supplied to the organic light emitting display, e.g., the first and the second power sources are coupled to the organic light emitting display, or may be determined based on previously extracted stored/supplied information, e.g., as a device specification.

The converting unit 190 may store the information supplied from the sensing unit 180, e.g., information regarding deterioration of the OLEDs and information regarding threshold voltage and mobility of the driving transistors. The converting unit 190 may include a memory unit (see, e.g., 191 of FIG. 3) including a non-volatile memory (see, e.g., 1913 of FIG. 8) and a volatile memory (see, e.g., 1914 of FIG. 8) and a converting circuit (see, e.g., 192 of FIG. 3). The converting circuit 192 may convert data Data input from the timing controller 150 into corrected data Data' so that an image with improved brightness uniformity may be displayed. More particularly, the converting circuit 192 may convert data Data input from the timing controller 150 into corrected data Data' based on the information stored in the memory unit 191 so as to reduce and/or eliminate variations in brightness based on, e.g., deterioration of the OLEDs and/or deviation in threshold voltage and mobility of the driving transistors.

More particularly, the data Data, which may be externally supplied, may be input to the converting unit 190 in accordance with the timing controller 150, and the data Data may be converted into the corrected data Data' and supplied to the data driver 120. Thus, the converting unit 190 may compensate for deterioration of the OLEDs and threshold voltage and mobility of the driving transistors.

The data driver 120 may generate the data signals based on the corrected data Data' and may supply the generated data signals to the pixels 140.

Figure 2:
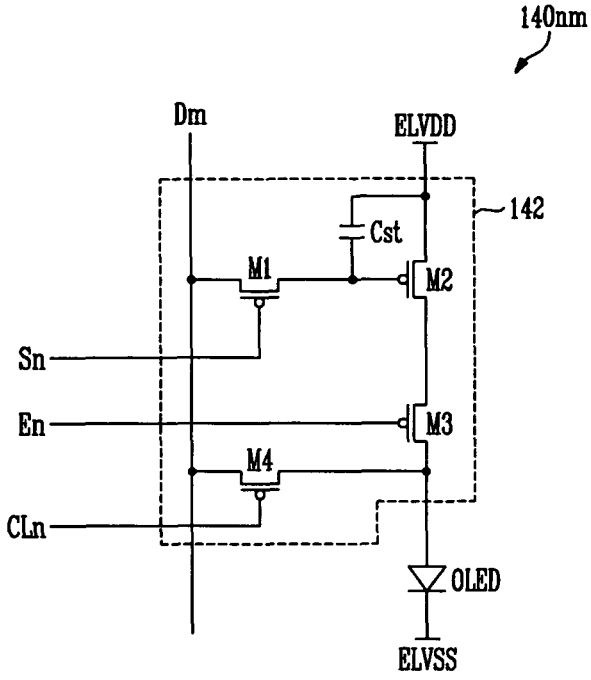
FIG. 2 illustrates a circuit diagram of an exemplary embodiment of a pixel employable by the organic light emitting display of FIG. 1.

FIG. 2 illustrates a circuit diagram of an exemplary embodiment of a pixel 140*nm* employable by the organic light emitting display of FIG. 1. For convenience, the pixel 140*nm* coupled to the mth data line Dm and the nth scan line Sn will be illustrated and described as an exemplary pixel. Features described herein with regard to the exemplary pixel 140*nm* may be employed by one, some or all of the pixels 140.

Referring to FIG. 2, the pixel 140*nm* according to the embodiment of the present invention includes an OLED and a pixel circuit 142 for supplying current to the OLED.

An anode electrode of the OLED may be coupled to the pixel circuit 142 and a cathode electrode of the OLED may be coupled to the second power source ELVSS. The OLED may generate light with brightness corresponding to current supplied from the pixel circuit 142.

The pixel circuit 142 may receive the data signal supplied to the data line Dm when a scan signal is supplied to the scan line Sn. In addition, the pixel circuit 142 may provide information regarding deterioration of the OLED and/or information regarding threshold voltage and mobility of the driving transistor, e.g., second transistor M2, to the sensing unit 180 when a sensing signal is supplied to the sensing line CLn. Referring to FIG. 2, the pixel circuit 142 may include a plurality of transistors, e.g., first, second, third, and fourth transistors, M1, M2, M3, M4 and a storage capacitor Cst.

A gate electrode of the first transistor M1 is coupled to the scan line Sn and a first electrode of the first transistor M1 is coupled to the data line Dm. A second electrode of the first transistor M1 is coupled to a first terminal of the storage capacitor Cst. In the description, it should be understood that the first electrode and the second electrode are different electrodes. For example, when the first electrode is a source electrode, the second electrode is a drain electrode.

The first transistor M1 may be turned on when the scan signal is supplied to the scan line Sn. The scan signal may be supplied, e.g., low state, so as to turn on the first transistor M1 during a period when information regarding the threshold voltage and mobility of the second transistor M2 is extracted, e.g., sensed or determined from device specifications, and during a period when the data signal is stored in the storage capacitor Cst.

A gate electrode of the second transistor M2 is coupled to the first terminal of the storage capacitor Cst and a first electrode of the second transistor M2 is coupled to a second terminal of the storage capacitor Cst and the first power source ELVDD.

The second transistor M2 may be a driving transistor for controlling an amount of driving current supplied to the OLED. More particularly, e.g., the second transistor M2 may control the amount of current that flows from the first power source ELVDD to the second power source ELVSS via the OLED based on a voltage stored in the storage capacitor Cst. The OLED may generate light having characteristics corresponding to the amount of the current supplied from the second transistor M2.

A gate electrode of the third transistor M3 is coupled to the emission control line En and a first electrode of the third transistor M3 is coupled to a second electrode of the second transistor M2. A second electrode of the third transistor M3 is coupled to the OLED. The third transistor M3 may be turned off when an emission control signal is not supplied to the emission control line En and may be turned on when the emission control signal is supplied. The emission control signal may not be supplied during a period when a voltage corresponding to the data signal is charged in the storage capacitor Cst and during a period when information regarding deterioration of the OLED is sensed so that the third transistor M3 is turned off.

A gate electrode of the fourth transistor M4 is coupled to the sensing line CLn and a first electrode of the fourth transistor M4 is coupled to the second electrode of the third transistor M3. In addition, a second electrode of the fourth transistor M4 is coupled to the data line Dm. The fourth transistor M4 may be turned on when the sensing signal is supplied, e.g., low state, to the sensing line CLn and may be turned off when the sensing signal is not supplied, e.g., has a high state. The sensing signal may be supplied so as to turn on the fourth transistor M4 during a period when the information regarding deterioration of the OLED is sensed and during a period when the information regarding the threshold voltage and mobility of the second transistor M2 is sensed/extracted.

Figure 3:
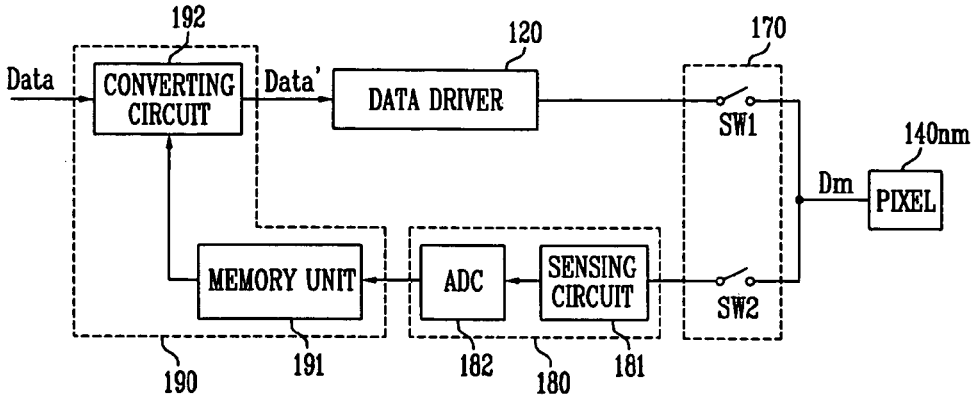
FIG. 3 illustrates a block diagram of exemplary embodiments of a switching unit, a sensing unit, and a converting unit employable by the organic light emitting display of FIG. 1.
Figure 4:
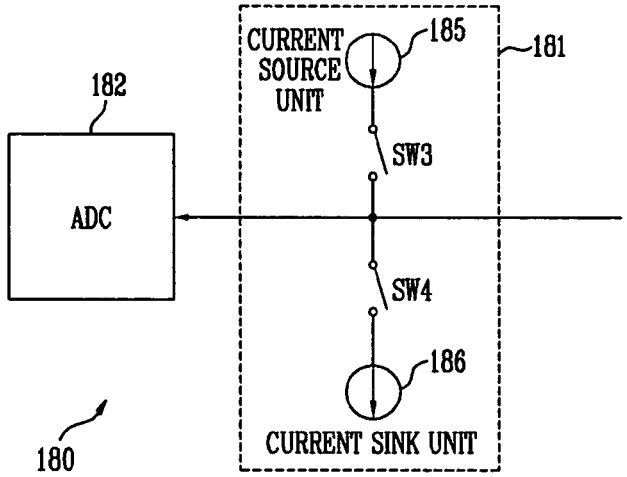
FIG. 4 illustrates a block diagram of an exemplary embodiment of a sensing circuit employable by the converting unit of FIG. 3.

FIG. 3 illustrates a block diagram of exemplary embodiments of the switching unit 170, the sensing unit 180, and the converting unit 190 employable by the organic light emitting display of FIG. 1. In FIG. 3, for convenience, the pixel 140*nm* coupled to the mth data line Dm will be illustrated. It should be understood that, e.g., features described may be applied to one, some or all of the data lines 1 to m. That is, e.g., the display may include a plurality of the switching units 170, a plurality of the sensing units 180, a plurality of the converting units 190, and each of the data lines 1 to m may be coupled to a respective one of the switching unit 170, a respective one of the sensing units 180, and a respective one of the converting units 190. FIG. 4 illustrates a block diagram of an exemplary embodiment of the sensing circuit 181 employable by the sensing unit 180 of FIG. 3

Referring to FIG. 3, the switching unit 170 may include a plurality, e.g., a pair, of switching elements SW1, SW2. The converting unit 190 may include a memory 191 and a converting circuit 192.

More particularly, each channel or column, e.g., 1 to m, of the pixel unit 140 may be associated, e.g., with the pair of switching elements SW1 and SW2 of the corresponding switching unit 170. The sensing unit 190 may include a sensing circuit 181 and an analog digital converter (hereinafter, referred to as ADC) 182. The sensing unit 180 may be associated with one, some or all of the channels or data lines 1 to m, e.g., each of the sensing units 180 may be associated with a respective one of the channels, each of the sensing units 180 may be associated with a respective plurality of the channels, or one sensing unit 180 may be associated with all the channels, etc.

More particularly, referring to FIG. 3, the first switching element SW1 of the switching unit 170 may be positioned between the data driver 120 and the data line Dm. The first switching element SW1 may be turned on when the data signal is supplied through the data driver 120. That is, the first switching element SW1 may maintain a turn-on state during a period when the organic light emitting display displays a predetermined image.

The second switching element SW2 of the switching unit 170 may be positioned between the sensing unit 180 and the data line Dm. The second switching element SW2 may be turned on while the information regarding the deterioration of the OLED and/or the information regarding the threshold voltage and mobility of the second transistor M2 is extracted/sensed by each of the pixels 140 of the pixel unit 130 through, e.g., the device specification/the sensing unit 180.

The second switching element SW2 may maintain a turned-on state during a non-display time, e.g., a non-display time that occurs after the power source is applied to the organic light emitting display and before an image is displayed, or during a non-display period when such information is extracted from the previously sensed device specifications.

More specifically, e.g., when information regarding deterioration of the OLEDs is sensed, the deterioration information may be sensed during a first non-display period after power is applied to the organic light emitting display and before an image is displayed. That is, the information regarding deterioration of the OLEDs may be sensed whenever power is supplied to the organic light emitting display.

When information regarding the mobility and threshold voltage of the second transistor M2 is sensed, the deterioration information may be sensed during a second non-display period after power is supplied to the organic light emitting display and before an image is displayed, or may be extracted from information previously sensed, e.g., previously determined device specifications supplied with the display.

Referring to FIG. 4, the sensing circuit 181 may include a current source unit 185 and a current sink unit 186 and switching elements SW3 and SW4 coupled to the current source unit 185 and the current sink unit 186, respectively.

The current source unit 185 may supply first current to the pixel 140 when the third switching element SW3 is turned on. A predetermined voltage, e.g., a first voltage, may be generated by the data line Dm when the first current is supplied to the ADC 182. The first current may be supplied via the OLED included in the pixel 140. Therefore, the information on the deterioration of the OLED may be included in the first voltage.

More specifically, as the OLED deteriorates a resistance value of the OLED changes. Therefore, a voltage value of the first voltage changes corresponding to the deterioration of the OLED so that the information on the deterioration of the OLED may be extracted based on the voltage value of the first voltage.

In some embodiments, a current value of the first current may be varied so that a predetermined voltage may be applied within a predetermined time. For example, the first current may be variably set as the current value to be flown to the OLED when the pixel 140 emits light with the maximum brightness.

The current sink unit 186 may sink the second current from the pixel 140 when the fourth switching element SW4 is turned on. A predetermined voltage, e.g., a second voltage, may be generated by the data line Dm when the second current is sunk is supplied to the ADC 182. The second current may be supplied via the second transistor M2 included in the pixel 140. Therefore, the information regarding the threshold voltage and mobility of the second transistor M2 may be included in the second voltage. A current value of the second current may be set so that the information on the threshold voltage and mobility of the second transistor M2 may be stably extracted. For example, the current value of the second current may be set as the same current value of the first current.

Referring still to FIG. 4, the sensing circuit 181 is illustrated as including one current sink unit 186. However, embodiments are not limited thereto. More particularly, e.g., the sensing circuit 181 may include one or more current sink units 186. For example, the sensing circuit 181 may include two current sink units having two different current values. In such a case, the information on the threshold voltage and mobility of the second transistor M2 may be determined based on the voltages, e.g., the second voltages, corresponding to the currents of the two current sink units.

The ADC 182 may convert the first voltage into a first digital value and may convert the second voltage into a second digital value, and may supply the first digital value and the second digital value to the converting unit 190.

Referring again to FIG. 3, the converting unit 190 may include the memory 191 and the converting circuit 192.

The memory 191 may store the first digital value and the second digital value supplied from the ADC 182. Actually, the memory 191 may store the information on the threshold voltage and mobility of the second transistor M2 of each of the pixels 140 included in the pixel unit 130 and the information on the deterioration of the OLEDs.

Figure 8:
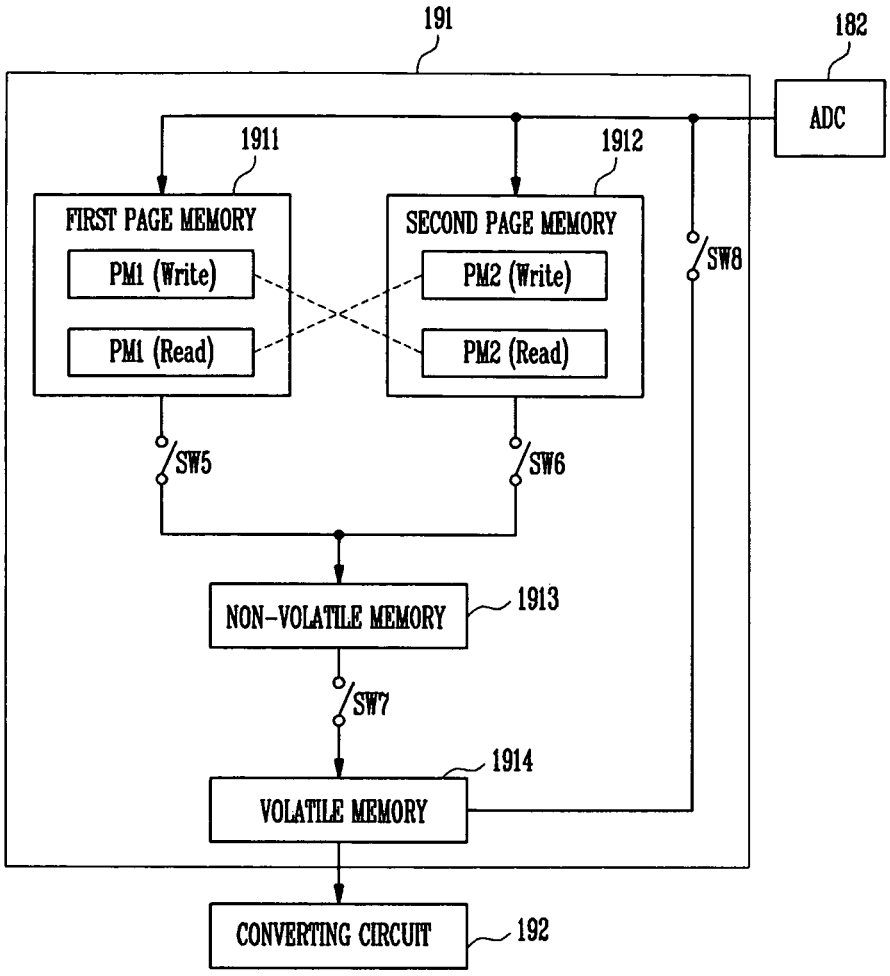
FIG. 8 illustrates a block diagram of an exemplary embodiment of the memory unit of FIG. 3.

More particularly, in embodiments, the memory unit 191 may include a non-volatile memory (see, e.g., 1913 of FIG. 8) and a volatile memory (see, e.g., 1914 of FIG. 8). The non-volatile memory may be employed to stably store the information on the threshold voltage and mobility of the second transistor M2 and the information on the deterioration of the OLED, and the volatile memory may be employed to improve, e.g., speed up, an operation frequency characteristic of the memory unit 191.

For example, the information items stored in the non-volatile memory may be moved to the volatile memory having a relatively fast operation frequency characteristic and the volatile memory may supply the information to the converting circuit 192. With the volatile memory supplying the information to the converting circuit 192, operations of the converting circuit 192 may be performed at relatively higher speed.

In embodiments, when the information items are stored in the non-volatile memory, read/write operations may be alternately performed using a plurality of page memories so that a time employed for storing the information items in the non-volatile memory may be reduced.

Embodiments may be separately advantageous, e.g., in a situation when a time for storing information in the non-volatile memory is not available and/or may delay operation of the display, by enabling the information to be more expediently stored in the volatile memory, e.g., directly from the ADC 182. Thereafter, e.g., after the information is employed for a high speed operation, the information may be moved from the volatile memory to the non-volatile memory and stably stored in the non-volatile memory. A detailed exemplary structure of the above-described memory unit 191 will be described below.

The converting circuit 192 may convert the input data Data received from the timing controller 150 into the corrected data Data' based on the first and/or second digital values stored in the memory 191 in order to improve brightness uniformity, e.g., so that image brightness may not be affected and/or may be less affected by deterioration of the OLEDs and/or deviations in threshold voltage and/or mobility of the driving transistors, e.g., M2. Thus, embodiments may provide a display and/or driving method thereof that is capable of displaying an image with improved uniform brightness regardless of the deterioration of the OLED and the deviation in the threshold voltage and mobility of the driving transistor M2.

The data driver 120 may generate the data signal using the corrected data Data' and may supply the generated data signal to the respective pixel 140*nm*.

Figure 5:
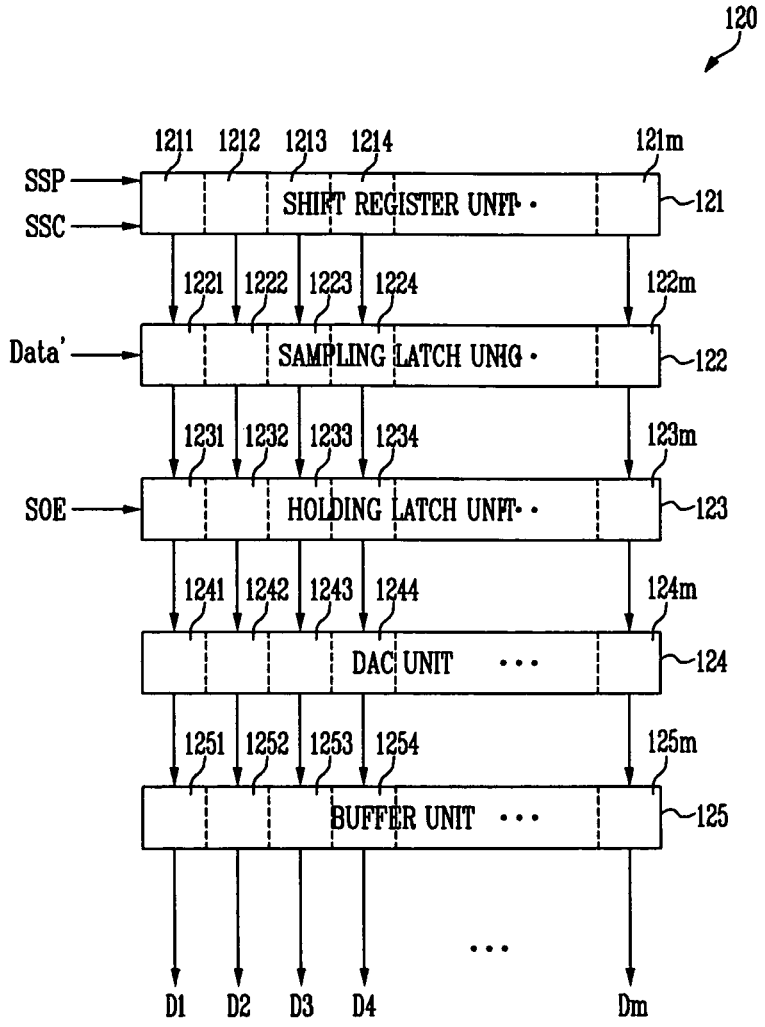
FIG. 5 illustrates a block diagram of an exemplary embodiment of the data driver employable by the organic light emitting display of FIG. 1.

FIG. 5 illustrates a block diagram of an exemplary embodiment of the data driver 120 employable by the organic light emitting display of FIG. 1.

Referring to FIG. 5, the data driver 120 may include a shift register unit 121, a sampling latch unit 122, a holding latch unit 123, a digital-to-analog converting unit (hereinafter, referred to as a DAC unit) 124, and a buffer unit 125.

The shift register unit 121 may receive a source start pulse SSP and a source shift clock SSC from the timing controller 150. The shift register unit 121 that received the source shift clock SSC and the source start pulse SSP may sequentially generate m sampling signals while shifting the source start pulse SSP every one period of the source shift clock SSC. The shift register 121 may include m shift registers 1211 to 121*m*.

The sampling latch unit 122 may sequentially store the corrected data Data' supplied from the converting unit 190 in response to the sampling signals sequentially supplied from the shift register unit 121. The sampling latch unit 122 may include m sampling latches 1221 to 122*m* in order to store the m corrected data Data'.

The holding latch unit 123 may receive a source output enable (SOE) signal from the timing controller 150. The holding latch unit 123 that received the SOE signal may receive the corrected data Data' from the sampling latch unit 122 and may store the received corrected data Data'. The holding latch unit 123 may supply the corrected data Data' stored therein to the DAC unit 124. The holding latch unit 123 may include m holding latches 1231 to 123*m*.

The DAC unit 124 may receive the corrected data Data' from the holding latch unit 123 and may generate m data signals corresponding to the received corrected data Data'. The DAC unit 124 may include m digital-to-analog converters (DAC) 1241 to 124*m*. More particularly, e.g., the DAC unit 124 may generate m data signals using the DACs 1241 to 124*m* positioned in channels, respectively, and may supply the generated data signals to the buffer unit 125.

The buffer unit 125 may supply the m data signals supplied from the DAC unit 124 to the m data lines D1 to Dm. The buffer unit 125 may include m buffers 1251 to 125*m*.

Figure 6:
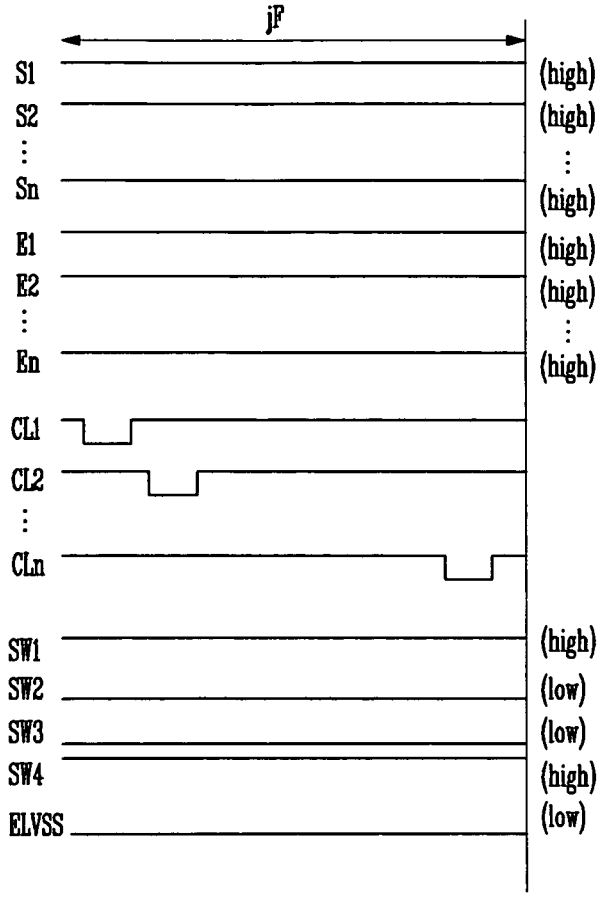
FIG. 6 illustrates an exemplary timing diagram of exemplary signals employable for extracting information regarding deterioration of an organic light emitting diode (OLED)

FIG. 6 illustrates an exemplary timing diagram of exemplary signals employable for extracting information regarding deterioration of an OLED. In FIG. 6, it is assumed that the information on the deterioration of the OLED is extracted during a first non-display period after power is applied to the organic light emitting display and before an image is displayed.

Referring to FIG. 6, a high level voltage is applied to the scan lines S1 to Sn and the emission control lines E1 to En during the first non-display period. Sensing signals may be sequentially supplied to the sensing lines CL1 to CLn during a j frame jF period of the first non-display period.

In the exemplary embodiment of FIG. 6, during the first non-display period, the first switching element SW1 and the fourth switching element SW4 may receive a high level voltage and may be turned off and the second switching element SW2 and the third switching element SW3 may receive a low level voltage and may be turned on. During the first non-display period, the voltage of the second power source ELVSS may maintain a low level.

When a sensing signal is supplied to the first sensing line CL1 in the jth frame jF, the fourth transistors M4 of the pixels 140 coupled to the first sensing line CL1 may be turned on. In this case, the first current supplied from the current source unit 185 associated with each of the channels may flow to the second power source ELVSS via the fourth transistors M4 and the OLEDs of the pixels 140, respectively.

As a result, the respective first voltage generated by the anode electrode of the OLED may be converted into a first digital value by the ADC 182. The ADC 82 may then supply the first digital value to the memory unit 191 for storage therein.

As described above, the sensing signals may be sequentially supplied via the first sensing line CL1 to the nth sensing line CLn in the j frame jF so that the first digital values corresponding to the pixels 140 may be stored in the memory unit 191.

Figure 7:
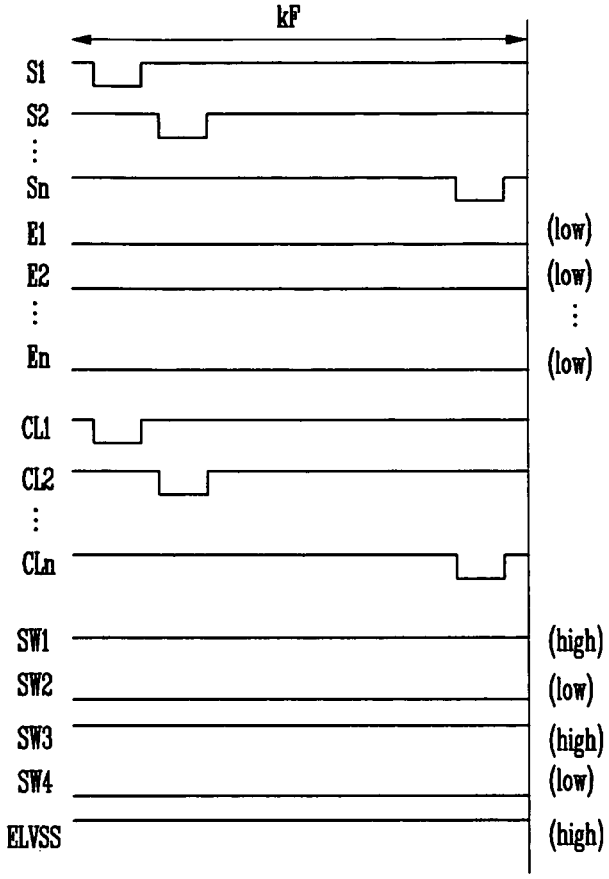
FIG. 7 illustrates an exemplary timing diagram of exemplary signals employable for extracting information regarding threshold voltage and mobility of a driving transistor.

FIG. 7 illustrates an exemplary timing diagram of exemplary signals employable for extracting information regarding threshold voltage and mobility of a driving transistor, e.g., M2. In FIG. 7, it is assumed that the information regarding the threshold voltage and mobility of the driving transistor is being extracted during a second non-display period after power is applied to the organic light emitting display and before an image is displayed.

Referring to FIG. 7, during the second non-display period after the first non-display period, the scan signals may be sequentially supplied to the scan lines S1 to Sn and the sensing signals may be sequentially supplied to the sensing lines CL1 to CLn. During the second non-display period, a low level voltage may be applied to the emission control lines E1 to En.

In addition, during the second non-display period, the first switching element SW1 and the third switching element SW3 may receive a high level voltage to be turned off and the second switching element SW2 and the fourth switching element SW4 may receive a low level voltage to be turned on. During the second non-display period, the voltage of the second power source ELVSS may maintain a high level.

When a scan signal is supplied to the first scan line S1 during a k (k is a natural number) frame kF, the first transistors M1 of the pixels 140 coupled to the first scan line S1 may be turned on. In addition, when a sensing signal is supplied to the first sensing line CL1 during the k frame kF, the fourth transistors M4 of the pixels 140 coupled to the first sensing line CL1 may be turned on. In this case, the second current may be sunk by the current sink unit 186 from the first power source ELVDD via the second transistors M2, the third transistors M3, the fourth transistors M4, the data lines, and the fourth switching elements SW4 included in the pixels 140 coupled to the first scan line S1.

At this time, the second voltage generated by the gate electrode of the second transistor M2 may be converted into a second digital value by the ADC 182. The ADC 82 may then supply the second digital value to the memory unit 191 for storage therein.

With same method as described above, the scan signals may be sequentially supplied to the scan lines S1 to Sn and the sensing signals may be sequentially supplied to the sensing lines CL1 to CLn during the k frame kF so that the second digital values corresponding to the pixels 140 may be stored in the memory unit 191.

FIG. 8 illustrates a block diagram of an exemplary embodiment of the memory unit 191 of FIG. 3.

Referring to FIG. 8, the memory unit 191 may include a non-volatile memory 1913 and a volatile memory 1914 capable of exchanging information, first and second page memories 1911 and 1912 for storing the information supplied from the ADC 182 in the non-volatile memory 1913, fifth and sixth switching elements SW5 and SW6 for coupling the first and second page memories 1911 and 1912 to the non-volatile memory 1913, a seventh switching element SW7 for coupling the non-volatile memory 1913 and the volatile memory 1914, and an eighth switching element SW8 for directly coupling the ADC 182 to the volatile memory 1914.

The first and second page memories 1911 and 1912 may receive the information on the deterioration of the OLED and the information on the threshold voltage and mobility (that is, the first and second digital values) of the driving transistor (that is, the second transistor M2) from the ADC 182 of the sensing unit and may store the received information items in the non-volatile memory 1913.

Here, the first and second page memories 1911 and 1912 may complementarily perform read and write operations during a period where the first and second digital values are stored in the non-volatile memory 1913 and are alternately coupled to the non-volatile memory 1913 by the fifth and sixth switching elements SW5 and SW6.

That is, the fifth switching element SW5 may be coupled between the first page memory 1911 and the non-volatile memory 1913 and the sixth switching element SW6 may be coupled between the second page memory 1912 and the non-volatile memory 1913. The fifth switching element SW5 and the sixth switching element SW6 may be alternately turned on. Therefore, the information items supplied from the first and second page memories 1911 and 1912 may be stored in the non-volatile memory 1913 at high speed.

Therefore, the information sensed by the sensing unit 180 in real time may not be stored in the non-volatile memory 1913 in real time.

When the first and second digital values are stored in the non-volatile memory 1913, the seventh switching element SW7 coupled between the non-volatile memory 1913 and the volatile memory 1914 may be turned on so that the information supplied from the non-volatile memory 1913 is stored in the volatile memory 1914.

Then, the converting circuit 192 may convert the input data Data into the corrected data Data' using the information stored in the volatile memory 1914.

That is, in embodiments, after storing the information on the deterioration of the OLED and the information on the threshold voltage and mobility of the driving transistor that are sensed by the sensing unit 180 in the non-volatile memory 1913, the information items supplied from the non-volatile memory 1913 may be moved to the volatile memory 1914 having a fast operation frequency to store the moved information items. Accordingly, embodiments may enable an operation such as data conversion or an operation that requires fast input and output to be performed with reference to the volatile memory 1914 so that the operation frequency characteristic of the memory unit 191 is improved.

An operation of moving the information items supplied from the non-volatile memory 1913 to the volatile memory 1914 having the fast operation frequency characteristic to store the information items may be performed during the non-display period after power is applied to the organic light emitting display and before an image is displayed and/or can be performed while being controlled by a specific control signal supplied from the timing controller 150.

Embodiments may enable storage speed to be increased when information items are stored in the non-volatile memory 1913 by using the first and second page memories 1911 and 1912.

During a high speed operation mode where the time for storing the information on the deterioration of the OLED or the information on the threshold voltage and mobility of the driving transistor in the non-volatile memory 1913 is insufficient, the information items supplied from the ADC 182 may be directly stored in the volatile memory 1914 without passing through the non-volatile memory 1913 and may be used for converting the corrected data Data' to increase the operation speed. Then, the information items stored in the volatile memory 1914 may be moved to the non-volatile memory 1913 so that the information items can be stably stored.

Therefore, an eighth switching element SW8 may be coupled between the ADC 182 and the volatile memory 1914. The fifth to eighth switching elements SW5 to SW8 may be controlled by the timing controller 150.

As described above, in embodiments, after moving the information items supplied from the non-volatile memory 1913 to the volatile memory 1914, an operation such as data conversion may be performed with reference to the volatile memory 1914 so that the operation frequency characteristic of the memory unit 191 may be improved.

Embodiments may separately enable, e.g., the read and write operations to be alternately performed using the first and second page memories 1911 and 1912 when information items are stored in the non-volatile memory 1913, so that the time for storing the information items in the non-volatile memory 1913 may be reduced.

In addition, when the time for storing the information items in the non-volatile memory 1913 is insufficient, after the information items supplied from the ADC 182 are directly stored in the volatile memory 1914 so that a high speed operation can be performed, the information items stored in the volatile memory may be moved to the non-volatile memory so that the information items can be stably stored.

Exemplary embodiments have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A method of driving an organic light emitting display, comprising:

extracting information on deterioration of an organic light emitting diode (OLED) and information on a threshold voltage and mobility of a driving transistor included in each of the pixels to store the information in a memory unit during a non-display period, extracting the information including:

storing the information on the deterioration of the OLED and the information on the threshold voltage and mobility of the driving transistor in a non-volatile memory, and storing the information in a volatile memory, converting input data into corrected data directly using the information items stored in the volatile memory; and supplying data signals corresponding to the corrected data to data line.

2. The method as claimed in claim 1, wherein converting input data into corrected data using the information items stored in the memory unit includes reducing and/or eliminating an effect of the deterioration of the OLED and/or deviation in the threshold voltage and mobility of the driving transistor on brightness of the pixels.

3. The method as claimed in claim 1, wherein storing the information in the non-volatile memory occurs before storing the information in the volatile memory.

4. The method as claimed in claim 1, wherein storing the information in the volatile memory occurs before storing the information in the non-volatile memory.

5. The method as claimed in claim 4, wherein converting the input data into corrected data includes using the information stored in the volatile memory before storing the information in the non-volatile memory.

6. The method as claimed in claim 1, wherein, extracting the information, includes:

extracting the information on the deterioration of the OLED and the information on the threshold voltage and mobility of the driving transistor to generate digital values;

storing the digital values in the non-volatile memory using a first page memory and a second page memory that are alternately coupled to the non-volatile memory; and moving the information stored in the non-volatile memory to the volatile memory to store the moved information.

7. The method as claimed in claim 6, wherein the first page memory and the second page memory complementarily perform read and write operations.

8. The method as claimed in claim 1, wherein, extracting the information includes:

sensing the information on the deterioration of the OLED during one frame period of the non-display period to generate a first digital value;

storing the first digital value in the memory unit;

sensing the information on the threshold voltage and mobility of the driving transistor during another frame period of the non-display period to generate a second digital value; and storing the second digital value in the memory unit.

9. The method as claimed in claim 8, wherein, generating the first digital value comprises:

supplying first current to the OLED; and converting a first voltage applied to the OLED corresponding to the first current into the first digital value.

10. The method as claimed in claim 8, wherein generating the second digital value comprises:

sinking second current via the driving transistor; and converting a second voltage applied to a gate electrode of the driving transistor into the second digital value corresponding to the second current.

11. The method as claimed in claim 8, wherein generating the second digital value and storing the second digital value in the memory unit are previously performed when generating specifications for the organic light emitting display.

12. The method as claimed in claim 1, wherein, extracting the information and converting the input data into corrected data are performed during the non-display period after a power is applied to the organic light emitting display and before an image is displayed.

13. An organic light emitting display, comprising:

a plurality of pixels coupled to data lines, scan lines, emission control lines, and sensing lines;

a sensing unit adapted to sense information on deterioration of an OLED and information on a threshold voltage and mobility of a driving transistor that are included in each of the pixels;

a converting unit adapted to store the information on the deterioration of the OLED and the information on the threshold voltage and mobility of the driving transistor that are sensed by the sensing unit and to convert input data into corrected data using the information; and a data driver adapted to receive the corrected data output from the converting unit to generate data signals, wherein the converting unit includes:

a memory unit adapted to store the information on the deterioration of the OLED and the information on the threshold voltage and mobility of the driving transistor, the memory unit including:

a non-volatile memory and a volatile memory that can exchange information, and a switching element arranged directly between the sensing unit and the volatile memory, and a converting circuit adapted to convert the input data into the corrected data using the information stored in the memory unit.

14. The organic light emitting display as claimed in claim 13, wherein the information on the deterioration of the OLED and the information on the threshold voltage and mobility of the driving transistor that are sensed by the sensing unit are stored in the non-volatile memory and are moved to the volatile memory to be stored, and wherein the converting unit converts the input data into the corrected data with reference to the volatile memory.

15. The organic light emitting display as claimed in claim 13, wherein the information on the deterioration of the OLED and the information on the threshold voltage and mobility of the driving transistor that are sensed by the sensing unit are directly stored in the volatile memory without passing through the non-volatile memory, and wherein the converting unit converts the input data into the corrected data with reference to the volatile memory.

16. The organic light emitting display as claimed in claim 13, wherein the memory unit further includes:

a first page memory and a second page memory adapted to receive the information on the deterioration of the OLED and the information on the threshold voltage and mobility of the driving transistor from the sensing unit and to store the received information in the non-volatile memory; and switching elements coupled between the first page memory and the non-volatile memory, between the second page memory and the non-volatile memory, and between the non-volatile memory and the volatile memory.

17. The organic light emitting display as claimed in claim 16, wherein the switching element coupled between the first page memory and the non-volatile memory and the switching element coupled between the second page memory and the non-volatile memory are alternately turned on during a period where the information items supplied from the first and second page memories are stored in the non-volatile memory.

18. The organic light emitting display as claimed in claim 17, wherein the switching elements coupled between the non-volatile memory and the volatile memory are turned on after the information items supplied from the first and second page memories are stored in the non-volatile memory.

19. The organic light emitting display as claimed in claim 13, wherein the sensing unit comprises:

a sensing circuit positioned in each channel and including a current source unit adapted to supply a first current to the pixels and at least one current sink unit adapted to sink second current from the pixels; and at least one analog-to-digital converter (ADC) adapted to convert a first voltage applied to the OLED into a first digital value corresponding to the first current and to convert a second voltage applied to a gate electrode of the driving transistor into a second digital value corresponding to the second current.

20. The organic light emitting display as claimed in claim 13, further comprising a switching unit adapted to couple one of the sensing unit and the data driver to the data lines.

21. The organic light emitting display as claimed in claim 13, wherein the converting circuit is connected directly to the volatile memory, the converting circuit being adapted to convert the input data into the corrected data using only the information stored in the volatile memory.

22. The organic light emitting display as claimed in claim 13, wherein the sensing unit is connected independently to each of the volatile memory and the non-volatile memory.

* * * * *